US008113364B1

(12) United States Patent
Asadi

(10) Patent No.: US 8,113,364 B1
(45) Date of Patent: Feb. 14, 2012

(54) NURSING BOTTLE ENSEMBLE

(76) Inventor: Ladan Asadi, Las Vegas, NV (US)

( * ) Notice: Subject to any disclaimer, the term of this patent is extended or adjusted under 35 U.S.C. 154(b) by 113 days.

(21) Appl. No.: 12/424,141

(22) Filed: Apr. 15, 2009

Related U.S. Application Data

(60) Provisional application No. 61/124,638, filed on Apr. 18, 2008.

(51) Int. Cl.
*A61J 9/08* (2006.01)
*B65D 1/04* (2006.01)

(52) U.S. Cl. ..... 215/6; 215/11.1; 215/11.6; 246/227

(58) Field of Classification Search ..... 215/6, 11.1, 215/11.6, 227, 252, 293, 322; 62/457.4; 446/227
See application file for complete search history.

(56) References Cited

U.S. PATENT DOCUMENTS

| | | | | |
|---|---|---|---|---|
| 2,483,870 | A * | 10/1949 | Bailey | 215/11.6 |
| 2,718,973 | A * | 9/1955 | Dahl et al. | 215/6 |
| 2,843,281 | A | 7/1958 | Gallois | |
| 2,994,448 | A * | 8/1961 | Sepe et al. | 215/395 |
| 4,076,139 | A * | 2/1978 | Larson | 215/11.6 |
| 4,324,111 | A * | 4/1982 | Edwards | 62/457.4 |
| 4,600,111 | A * | 7/1986 | Brown | 215/6 |
| 4,778,068 | A | 10/1988 | Kohus | |
| 4,882,914 | A * | 11/1989 | Haines-Keeley et al. | 62/457.4 |
| 5,069,351 | A * | 12/1991 | Gunderson et al. | 215/11.1 |
| 5,180,071 | A * | 1/1993 | Crosson | 215/11.1 |
| 5,207,338 | A * | 5/1993 | Sandhu | 215/11.1 |
| 5,312,282 | A * | 5/1994 | Cooper | 446/27 |
| 5,402,810 | A | 4/1995 | Donley | |
| D392,512 | S | 3/1998 | Bennett et al. | |
| 5,722,537 | A | 3/1998 | Sigler | |
| 5,807,156 | A * | 9/1998 | Owen | 446/77 |
| 6,116,439 | A | 9/2000 | Yaniv | |
| D446,454 | S | 8/2001 | Frank | |
| 6,851,569 | B2 * | 2/2005 | Conti et al. | 220/297 |
| 6,920,991 | B2 | 7/2005 | Holley, Jr. | |
| 6,945,393 | B2 | 9/2005 | Cho | |
| 7,055,709 | B1 * | 6/2006 | Esau | 215/228 |
| 7,100,782 | B2 * | 9/2006 | Hanna | 215/11.6 |
| 7,150,369 | B1 | 12/2006 | Fryar | |
| 7,331,478 | B2 | 2/2008 | Aljadi | |
| 7,351,251 | B2 * | 4/2008 | Garrett | 606/236 |
| 2002/0008116 | A1 * | 1/2002 | Sorenson et al. | 222/1 |
| 2005/0257562 | A1 * | 11/2005 | Wilson et al. | 62/457.4 |
| 2007/0221603 | A1 | 9/2007 | Moss | |
| 2008/0251486 | A1 * | 10/2008 | Housley et al. | 215/11.5 |
| 2008/0251655 | A1 * | 10/2008 | Housley | 248/102 |

FOREIGN PATENT DOCUMENTS

| | | |
|---|---|---|
| WO | WO/2004/026220 | 1/2004 |
| WO | WO/2005/041851 | 12/2005 |

* cited by examiner

*Primary Examiner* — Sue Weaver

(57) ABSTRACT

A nursing bottle ensemble having a dual chamber bottle, cap assembly and bottle sleeve including an upper feeding chamber attachable to a lower nipple storage chamber by threading means. Upper feeding chamber with a conventional nipple and ring assembly attached to the bottle top. A cap assembly having an upper cap portion used for storing nipples, pacifiers or snack attachable to a lower cap portion used for bottle closure. The bottle sleeve providing protection for the bottle while occupies the baby with movement of colorful ornaments inside the clear casing filled with non-toxic gel.

17 Claims, 4 Drawing Sheets

NURSING BOTTLE ENSEMBLE

PRIORITY UNDER 35 U.S.C. SECTION 119(e) & 37 C.F.R. SECTION 1.78

This Non Provisional application claims priority based upon the prior U.S. Provisional Patent application No. 61/124,638, entitled Nursery bottle and nipple chamber, filed Apr. 18, 2008 in the name of Ladan Asadi which is hereby incorporated by reference for all purposes.

FIELD OF INVENTION

The present invention relates to a dual chamber nursing bottle, a stackable cap assembly with storage and a decorative bottle sleeve for bottle protection, very useful for traveling and when away from home.

BACKGROUND OF THE INVENTION

With today's fast paced lifestyle, many parents are often away from home with their infants and toddlers during feeding time. When at home, the parent can clean a contaminated nipple by simply rinsing it under warm water and quickly resume feeding the baby. When away from home, parents are often challenged with finding means to clean a contaminated nipple or cannot locate a spare nipple packed somewhere at the bottom of a crowded diaper bag. While away from home, nearly all parents and child caregivers have experienced the problem of a child dropping feeding bottle on the ground, contaminating the nipple and possibly damaging the bottle. This situation often occurs at an inopportune time and public locations where there are no amenities available or nearby and parents are desperate to find means for disinfecting the bottle nipple before inserting it back into the baby's mouth.

Replacing the nipple in use with the clean nipple conveniently located in the lower storage chamber can often solve this problem.

Furthermore, nipples are available in a variety of types, sizes and shapes. In some cases, it has been found that an infant or toddler prefers the shape of one nipple over another. A nipple that is suitable for a thin liquid such as juice or milk is not suitable for thicker beverages like a formula. Accordingly, a caregiver may be required to have several different baby bottles and different types of nipples available to take along when leaving home.

The multiple chambers are useful for packing many different types of nipples and even a pacifier. Therefore, there is a need for a baby bottle containing storage compartments that can accommodate a wide variety of nipples used with different beverages a baby consumes.

Numerous baby bottles have been patented and available on the market. In the past, the majority of baby bottles have been made from plastic material using Bisphenol A, commonly referred to as BPA, which is a synthetic chemical compound. BPA is actually the key monomer used in the production of polycarbonate (PC) plastic and epoxy resin. PC plastic is hard and often shatter-proof. It is used in a wide range of consumer products such as water bottles, food storage containers, and baby bottles. Bisphenol A, or BPA, has been recently thrust into the public spotlight because of its possible links to serious health issues especially for babies. The present invention will solve this problem by using only FDA approved plastic materials or glass to ensure safety of the baby.

The bottle sleeve benefits the parent and the baby by providing protection for the bottle against damage when dropped, while occupies the baby much like a toy with movement of colorful ornaments inside the clear casing filled with non-toxic gel.

Various types of portable cleaning containers are found on the market retaining cleaning fluid and very few are used to sanitize nipples and pacifiers. One particular container in Prior art patented under U.S. Pat. No. 5,722,537, issued to Sigler; Elizabeth, dated Mar. 3, 1998, entitled "Disinfectant container for pacifier or nipple", discloses a portable disinfectant container for an infant pacifier or infant nursing nipple, consisting of a half-oval shaped disinfectant container which is provided with a sponge that may be saturated with any appropriate non-toxic disinfectant solution. The disinfectant container has an attached hook for hanging on a purse, baby bag, stroller, or crib. The hinged lid of the disinfectant container may be flipped open and a pacifier or nipple inserted into a slit in the sponge for disinfecting purposes, the absorption qualities of the sponge preventing any type of spillage of the disinfectant.

The prior art utilizes a different type of container using sponge and disinfectant solution for sterilization of the nipple and pacifier, and although the container appears to be useful, it has an important shortcoming. It has been known that sponges attract bacteria; in fact sponges can serve as a medium for the growth of harmful bacteria or fungi, especially when the sponge is allowed to remain wet between uses and not cleaned properly.

Therefore, there is a need in the art for a safer method of providing a baby with a sterilized nipple; keeping pre-sterilized nipples or pacifier in a dry storage chamber attached to the feeding bottle protects the baby from intake of possible contaminations and harmful germs often living in porous sponge.

Patented under U.S. Design Pat. No. 5,402,810, Issued to Donley; Beth J., dated Apr. 4, 1995, entitled "Pacifier storage and washing apparatus and method", discloses a portable apparatus for storing and cleaning pacifiers, including a vessel having a vessel opening for containing cleaning fluid. Although this container may appear to be a useful item, however, such container having liquid cleaning solution inside can leak when not sealed properly therefore, it can stain and ruin other items in a carrying bag or a purse such as wallets, cell phones, and other valuable items. The dry nipple storage chamber solves this problem; it is safe and easily accessed to provide parents or caregivers with sanitized nipples without the mess of the liquid and chemical contents in a container.

A number of dual and multi chamber nursing bottles have been developed. For example; U.S. Pat. No. 6,920,991 issued to Holley, Jr, dated Jul. 26, 2005, entitled "Multi chambered container and two-piece adapter" discloses a multi-chambered substance containment apparatus for separately storing two or more substances in one container having a base and a hollow member that cooperate to open and close a passage between a first chamber provided by a bottle and a second chamber formed in the hollow member.

U.S. Pat. No. 2,843,281, issued to Amy E. Gallois, Jul. 15, 1958, entitled "Nursing bottle", discloses a nursing bottle having means for retaining the nipple in the bottle when the nipple is not in use, while also preventing the fluid within the bottle from contacting the nipple. Gallois further disclose a nursing bottle having a container secured to the sealed lower end thereof so that liquid or solids may be carried in conjunction with the bottle for use with the fluid carried in the bottle for feeding a baby.

In a Patent Application publication No. 20070221603 by inventor Kimberly Moss, dated Sep. 27, 2007, entitled "Baby bottle with side by side and attached compartments", Moss discloses a dual side by side chambered baby bottle with two substantially semi-cylindrical feeding reservoirs. Moss further discloses a baby bottle and container assembly having a fluid chamber with dual concentric threaded means at its lower end to receive either a standard size baby food jar, or food container with a larger threaded opening.

U.S. Pat. No. 7,150,369, issued to Fryar; Kimberly C., dated Dec. 19, 2006, entitled "Dual chamber infant bottle", discloses a dual chamber infant bottle for minimizing contamination of an entire batch of baby formula or milk includes an upper feeding reservoir with a conventional baby bottle nipple coupled to the top end thereof. The lower end of the feeding reservoir includes a base portion having an opening therethrough for receiving fluid from a storage reservoir. A valve assembly is removable disposed between the storage reservoirs and feeding reservoir for allowing selective flow therebetween.

U.S. Pat. No. 7,331,478, issued to Aljadi; Salma E., dated Feb. 19, 2008, entitled "Dual chamber nursery bottle", discloses a dual chamber nursery bottle including upper and lower cylindrical shaped chambers disposed on a common axis one above the other and separated from one another by a rotating valve assembly that is disposed on the common axis and in contact with the upper and lower chambers.

U.S. Pat. No. 6,116,439, issued to Yaniv; Wendy Solomon, dated Sep. 12, 2000, entitled "Baby bottle and milk storage assembly", discloses baby bottle and milk storage where the bottle assembly is configured such that a plurality of bottle segments may be joined in fluid communication in an end to end fashion.

U.S. Pat. No. 4,778,068, issued to Kohus; Louis M., dated Oct. 18, 1998, entitled "Baby-feeding bottle", discloses a segmented baby feeding bottle with a lower part and an upper part when assembled to each other, at a threaded connection, provide a container of larger capacity. A collar is mountable on either of the lower and upper parts. The upper part defines a receptor for mounting on the lower part to provide a container of larger capacity. To this extent, the upper part may only be used when attached to the lower part. More specifically, the upper part alone may not be used for either storage or dispensation of liquid nutrients.

There are number of cap assembly patent issued but one in particular having multiple cap members is U.S. Pat. No. 6,945,393, Issued to Cho; Young Kook, Sep. 20, 2005, entitled"Cap device for attachment to a container", discloses a device having an upper cap member connected to a middle cap member and middle cap member connected to a lower cap member and the lower cap member covering and sealing a neck of a container. A chamber for storing a predetermined substances defined by the connection of the middle cap member to the upper cap member. An aperture formed on the top plate member of the middle cap member. A sliding door placed on the top plate member for covering the aperture and enclosing the chamber with the door movable to an open position for discharge of any contents in the chamber. The lower cap member having an aperture formed therethrough for passage of any contents discharged through the aperture of the middle cap member into the container.

As Indicated above, a number of dual chamber bottles exist in the prior art. However, the dual chamber bottles referenced above either provide two beverage compartments or allow communication between contents of two chambers. Nowhere in the prior art is seen a nursery bottle having multiple dry storage compartment for keeping nipple and pacifier sanitized for a later use.

SUMMARY OF THE INVENTION

Broadly stated, the present invention comprises; a multiple chamber baby bottle, a cap assembly and a bottle sleeve configured in various shapes, sizes, styles, colors and designs. The bottle can have handles, multiple attachable compartments using various methods of attachment. A bottle sleeve or wrap for protecting a container and amusing the user includes a body, wherein the body is configured for holding or containing a bottle or other container. In one embodiment, the protective sleeve includes a tubular shaped body, having an inner wall made of flexible material and an outer wall, comprising a clear and durable silicone material with a mixture of non-toxic gel and ornament in between said inner wall and said outer wall with at least a first opening in the protective sleeve that is adapted for receiving a container. A slight movement will cause motion in the gel, causing floatation of the ornaments to amuse the user. In another embodiment, the body of the sleeve with two open receiving ends includes silicone casing filled with colorful, non-toxic gel with or without the ornament content; yet other embodiments include an adjustable ring or an adjustable wrap made of plastic or stretchable and flexible material, a clamp style ring with smooth surface preferably made of plastic or stretchable material having mating or fastening means at each end to secure one container above another. Accordingly, in certain embodiments, the bottle sleeve is a protective silicone wrap that is adapted to hold or contain a container, thereby protecting the container while entertaining the user. Said bottle sleeve could be used with existing containers; a beverage bottle, a cup, a sippy cup or other container and not limited to a baby bottle. The invention could have various embodiments, uses, styles, shapes, sizes, colors, material and methods in fabrication.

The present invention also relates to a container with multiple attachable compartments, more particularly but not by a way of limitation, in one embodiment the present invention is providing additional storage compartments such as a lower storage compartment and a dual cap assembly configured to be attachable to existing baby bottles using different methods not limited to threading method of attachment. Yet in another embodiment a cap assembly having a lower cap configured to snap into the external, annular groove around the bottle shoulder or can be configured to be attachable to the nipple ring by snap fit into a slot, snug fitting, or threaded on. Upper cap mounted onto the top portion of lower cap, preferably by a snap method or a friction method of closure. The space created between lower cap and upper cap used for storing additional spare nipples, pacifier or snack and the like. This keeps the nipple and pacifier clean at all times and always within hands reach until ready for use. When away from home or traveling, it is particularly helpful to be able to keep track of extra nipple or pacifier. The lower chamber and cap assembly configured to have different storage uses and are attachable to a variety of existing containers by various mating means, not limited to threading and friction methods of attachment.

In another embodiment, previously filed with the provisional application, the baby bottle comprising one cylindrically shaped body with an externally threaded neck and an externally threaded open base. Said cylindrically shaped body divided into an upper chamber and a lower chamber. The chambers are disposed one above the other along a common axis and separated by a permanent, thin barrier wall molded into the bottle using the Blow molding and mold injection methods. Plastic containers have to date been manufactured primarily by injection molding or blow molding processes. Said barrier wall is a plate made of the same non-BPA plastic material as the bottle and in sealing contact with the inner wall, preventing communication between upper chamber and lower chamber contents. The upper chamber for liquid nourishments, having externally threaded neck portion and a conventional nipple and ring assembly coupled to the top end thereof. Said lower storage chamber externally threaded at the open base coupled with an internally threaded closure cap to retain spare nipple or pacifier therein.

Although there are countless number of baby bottles and containers with closures, many containers with attachable compartments and various disinfecting products on the market, the present invention is a combination of all prior uses with a new use and functionality.

A common problem with many baby bottles has been use of plastic materials with hazardous BPA contents. The present invention comprises glass or FDA approved, non-BPA plastic such as clear or colored opaque plastic.

It is a principal object of the invention to provide a safe feeding device to a child or an infant by eliminating use of BPA material while offering parents and caregivers easy access to sanitized nipples without having to rinse a contaminated nipple, particularly when away from home where sanitizing contaminated nipple is difficult or not possible It is another object of the invention to provide additional storage compartments within the dual cap assembly for storing additional nipple, pacifier or food items such as formula or a snack.

Another object of the invention is to provide a feeding bottle usable with disposable liners.

A further object of the invention is to offer convenience and accessibility to parents on the go by providing multiple storage compartments attachable to a feeding bottle therefore preventing misplacement of essential feeding item stored in the compartments while away from home.

An even further object of the present invention is to provide a new and improved cap assembly configured to fit most containers and existing baby bottles, said cap assembly for storing materials or food items, made of a durable plastic and low cost in manufacturing with regard to material and labor. Cap assembly could be marketable as a separate entity.

Yet another object of the invention is to provide a protective sleeve for the bottle to prevent fracture or breakage of said bottle when dropped on a hard surface such as the ground.

Still another object of the invention is to provide a visually stimulating bottle sleeve having floating ornaments to entertain the baby during and after feeding.

BRIEF DESCRIPTION OF THE DRAWINGS

Further objects and advantages of the invention will become more clearly understood from the following detailed descriptions together with the accompanying drawings wherein.

DETAILED DESCRIPTION OF THE INVENTION

Figure 1:
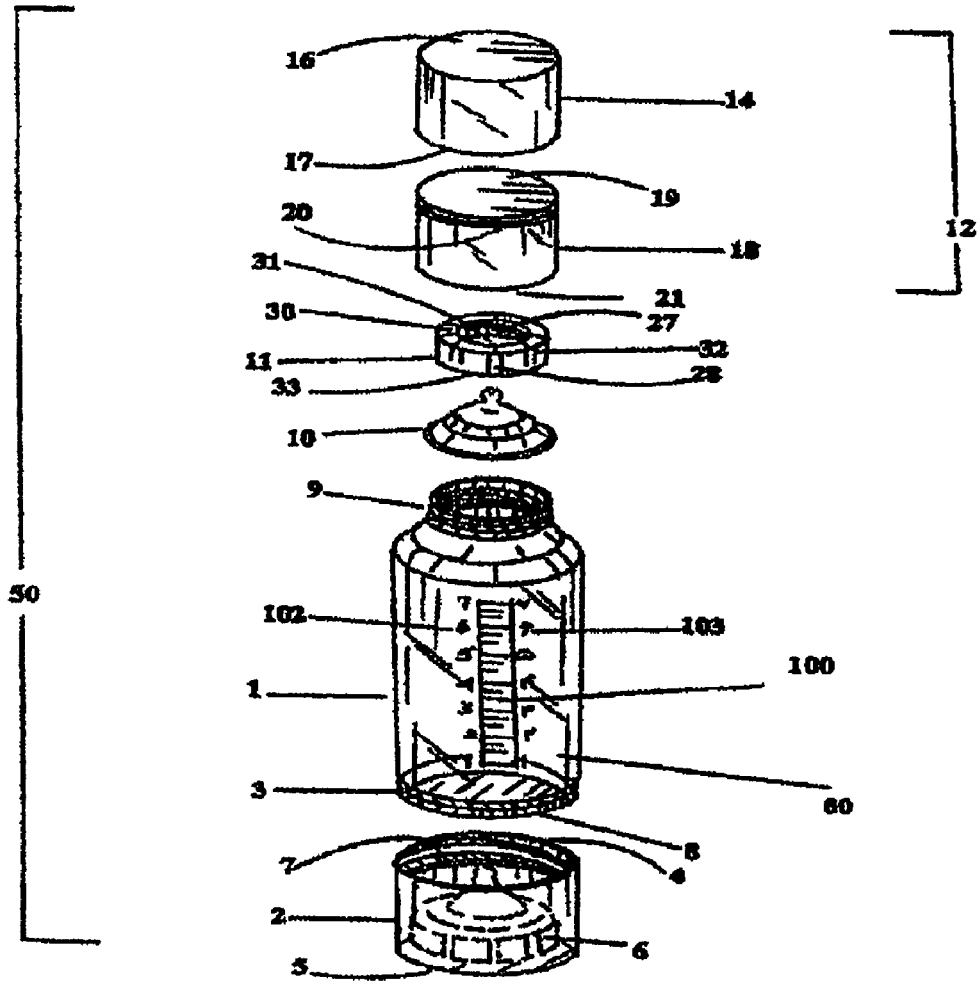
FIG. 1 is an exploded perspective illustration of dual chamber nursery bottle showing top and side views of feeding chamber, lower chamber, cap assembly and bottle attachments.

Referring to the drawings, and more particularly to FIGS. 1 through 4, generally designates an improved nursery bottle assembly 50 incorporating various features of the present invention configured to define a segmented configuration, with each bottle segment being useful for storing spare nipples or pacifier and dispensing food product consumed by an infant.

FIG. 1 demonstrates the bottle assembly 50 of present invention comprising an upper feeding chamber 1 for containing liquid nutrients, a fluid delivery measurement indicator 100 on the outer wall 60 of the feeding chamber 1 indicating the bottle volume.

To accommodate parents internationally, the measurement indicator 100 could be in most popular numeric systems, FIGS. 1 through 4 shows Arabic numeral 102 on one side and Eastern Arabic numeral 103 on opposite side of measurement indicator 100.

The bottle assembly 50 with at least one lower storage chamber 2 having a closed end 5 and an open mouth 4 for receiving spare nipple and ring assembly 6 or the like.

The lower storage chamber 2, with an internally threaded 7 open mouth 4 sized to mate with the externally threaded 3, closed base 8 of the upper feeding chamber 1. A cylindrically shaped stackable cap assembly 12 having an upper cap 14 with a closed top 16 and an open lower entrance 17. A lower cap 18 having a recessed annular groove 20, a closed top 19 and an open lower entrance 21 facing downwardly. The upper feeding chamber 1 further having an externally threaded neck portion 9 with a conventional nipple 10 and sealing ring 11 secured on top. The nipple 10 is in fluid communication with feeding chamber 1. The sealing ring 11 with a hollow frame consisting of a body portion 32 of a pre-determined diameter, a partial close top 30 having a circular opening at the center 31 smaller in diameter than the body portion 32 and bottom end 33 of same diameter. Body portion 32 having inner threading 27 for receiving a conventional nipple 10 mounted within to form the nipple and ring assembly 6 attachable to the externally threaded neck portion 9.

Figure 2:
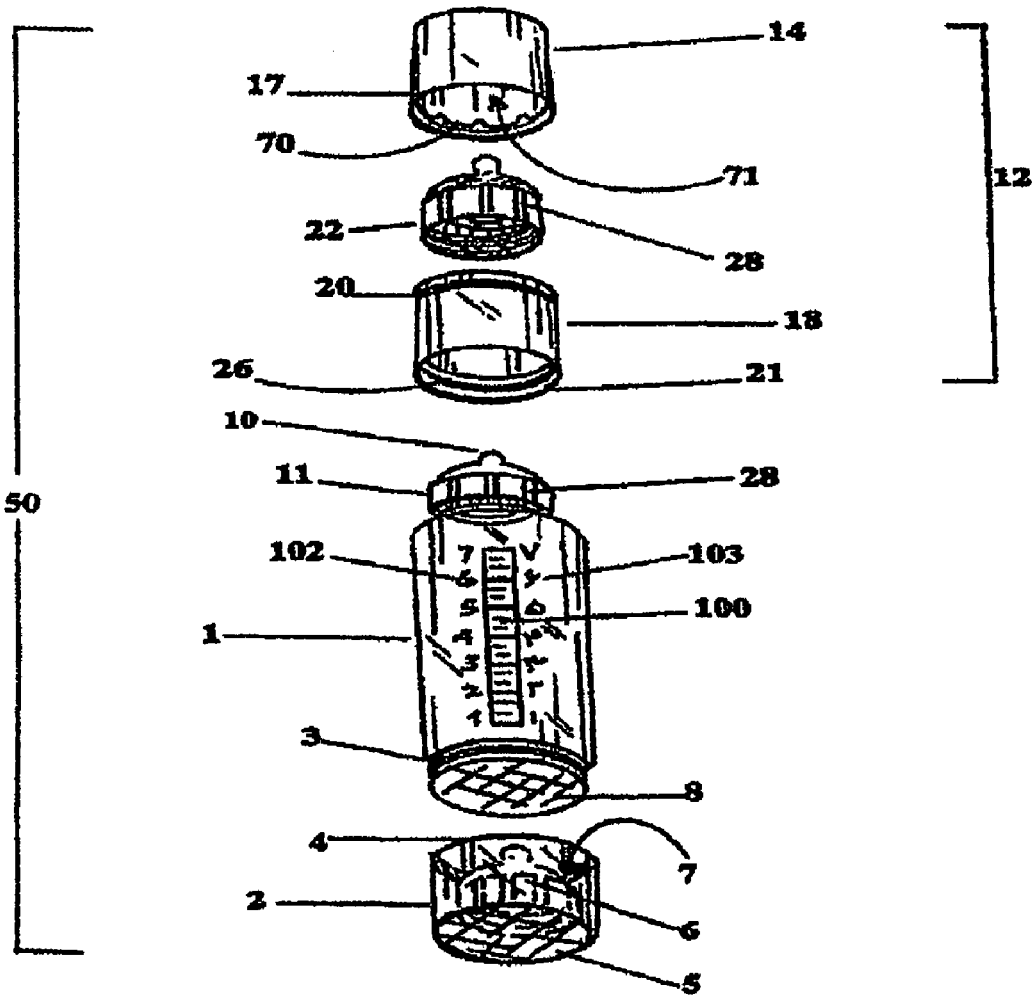
FIG. 2, is a perspective illustration of bottom and side views of dual chamber nursery bottle and nipple and ring assembly along with an exploded bottom and side views of cap assembly and the lower chamber.

FIG. 2 more clearly illustrated the individual components of bottle assembly 50 of the present invention. In this figure, various components are shown in an exploded perspective angle showing the bottom and side views. The exploded view of cap assembly 12 shows a clearer view of the attachment means and formation of the storage space between the upper cap 14 and the lower cap 18. The lower entrance 17 of the upper cap 14 having an internally protruding member 70, cooperatively engageable with recessed annular groove 20 of the lower cap 18 in an interlocking friction fit, creating a hollow storage space 71 in between used for storing additional nipple and ring assembly 22 or the like. The sealing ring 11 with external annular rib 28 projecting upwardly generally coaxially aligned about the axis and the lower cap member 18 having an internal ring protrusion 26 at the lower entrance 21, frictionally receiving the annular rib 28 of sealing ring 11 for closure. Lower chamber 2 with a closed end 5 and an internally threaded 7 open top 4 is attachable to the externally threaded 3 closed base 8 of feeding chamber 1, creating a secure storage space within lower chamber 2 used for storing spare nipple and ring assembly 6. A measurement indicator 100 in Arabic numeral 102 and Eastern Arabic numeral 103 shown on opposite side.

Figure 3:
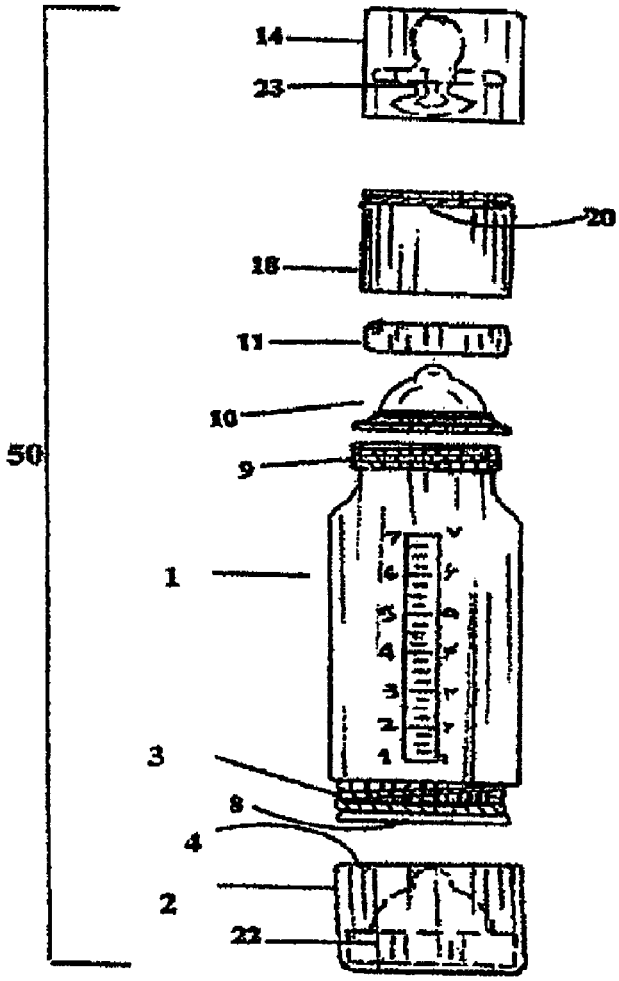
FIG. 3, is an exploded illustration of the front elevation of the dual chamber nursery bottle and cap assembly, demonstrating storage versatility by showing the contents using dashed hidden lines.

FIG. 3 is an exploded elevation of the present invention, showing the lower cap 18 with a recessed annular groove 20 This figure further demonstrates individual components of the bottle assembly 50. In this figure, a pacifier 23 is stored inside the upper cap 14 to demonstrate versatility in storage use.

Figure 4:
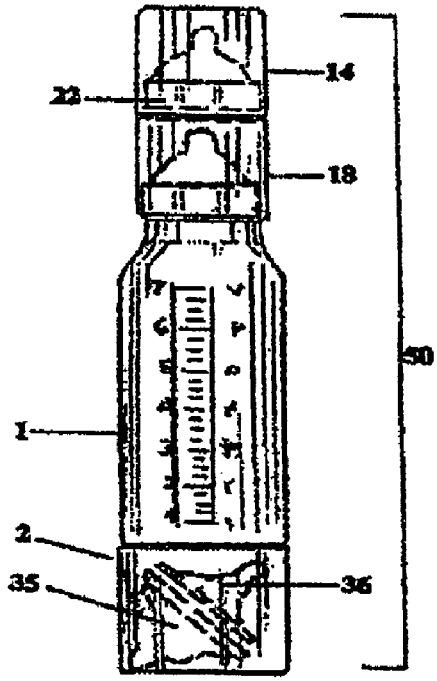
FIG. 4, is a front elevation illustration of assembled nursery bottle and storage compartments demonstrating various storing options by showing the contents using dashed hidden lines.

As shown in FIGS. 2 and 4, a nipple and ring assembly 22 is stored in upper cap 14. Depending on the baby's needs, Parents can store other small accessories or a snack in either the lower storage 2 or the upper cap 14.

FIG. 4 is an elevation view of the invention assembled. Bottle assembly 50 with all components attached showing stored accessories using dashed hidden lines. In this view, lower chamber 2 contains two different type nipples 35 and 36 and upper cap 14 containing nipple and ring assembly 22. Feeding chamber 1, lower chamber 2 and the cap assembly made from FDA approved plastic or other non-toxic materials used for manufacturing baby bottles and closure caps. The material can be in clear or non-clear opaque and in various colors.

Feeding chamber 1 and lower chamber 2 also made with glass material suitable for baby bottles. The preferred material for the nipple is silicone although latex is also used for this purpose.

Figure 5:
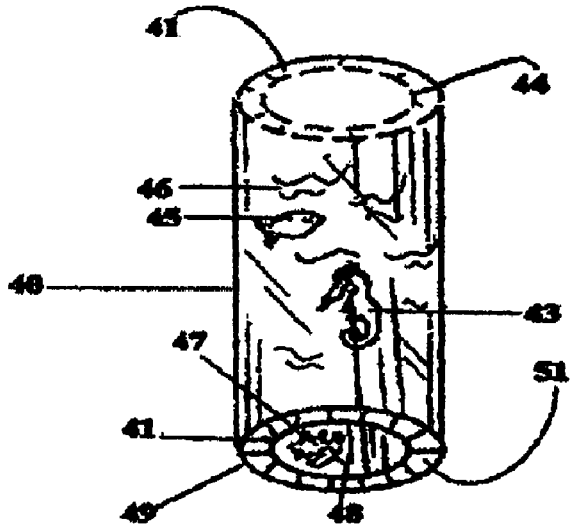
FIG. 5, is a bottom and side view illustration of the clear silicone bottle sleeve containing mixtures of non-toxic, thick gel combined with various ornamental figures to create visual stimulant and entertain the baby.

FIG. 5 is a description of a cylindrically shaped, decorative and protective bottle sleeve 40 preferably made from durable and heatproof silicone product.

Bottle sleeve 40, consisting of a tubular and hollow inner shell 48 with a diameter configured to be suitable to receive any conventional baby bottle, a tubular outer shell 49 slightly larger in diameter than the Inner shell 48, forming a gap pocket 41 in between. The open bottom end 51 of bottle sleeve 40 then sealed closed with proper bonding method to receive and hold in a pre-determined amount of special filling mixture introduced into the gap pocket 41 from the open top end 44. The special filling mixture consisting of a thick, non-toxic gel 46 and various types of ornaments 43, 45, 47 is added between outer shell 49 and inner shell 48 from the open top end 44 prior to sealing the open top end 44 closed by proper bonding method. A slight movement of the bottle sleeve 40 will cause motion in the gel 46 causing floatation in various ornaments 45, 43, 47 to amuse the baby. The bottle sleeve 40 may have different themes by using different types of ornaments. FIG. 5 illustrating only three of many ornaments that can be used in an aquarium theme used for illustration.

Figure 6:
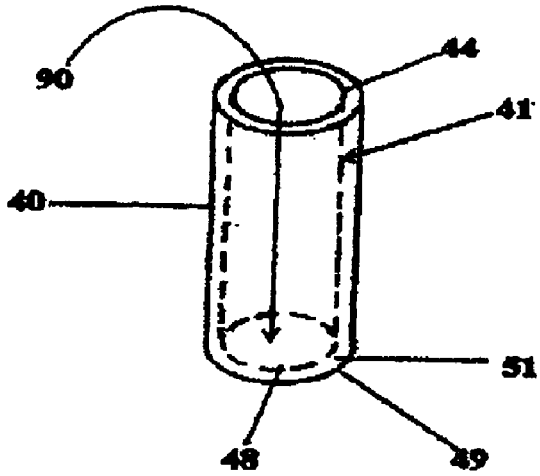
FIG. 6, is a Top and side view of the bottle sleeve showing inner tube with dashed hidden lines.

FIG. 6 is a top view of the bottle sleeve 40 having a hollow passageway 90 in the center for receiving a baby bottle or the like. The tubular inner shell 48, demonstrated by using dashed hidden lines, inside an outer shell 49, configured larger in diameter than inner shell 48, creating a gap pocket 41 with a predetermined width in between.

Although the various components of the bottle assembly 50 of the present invention are disclosed as being attached together either using cooperating threaded portions or friction method of closure, it is not intended that the present invention be limited to mentioned attachment mechanism. Moreover, it will be understood that any conventional attachment mechanism or methods, whether presently known or devised in the future, may be used to secure the various components of the present invention in a sealed fashion one to the other.

From the foregoing description, it will be recognized by those skilled in the art that a baby bottle assembly offering advantages over the prior art has been provided. Specifically, the bottle assembly defines a segmented configuration, with each segment being useful for storing accessories and dispensing a food product for feeding an infant. The cap assembly of the invention configured to be used with existing standard baby bottles.

While a preferred embodiment has been shown and described, it will be understood that it is not intended to limit the disclosure, but rather it is intended to cover all modifications and alternate methods of attachment falling within the spirit and the scope of the invention as defined in the claims.

Having thus described the aforementioned invention, the embodiments of the invention in which an exclusive property or privilege is claimed are defined as follows:

1. An improved nursery ensemble for traveling defining multiple members and at least one of said members being a useful storage chamber within hands reach, wherein said storage chamber adapted to removably engage to an end of a feeding chamber and said storage chamber further sized and dimensioned for retaining therein sanitary feeding essentials comprising: a dual chamber container defining an upper said feeding chamber and a lower said storage chamber and said chambers having a generally circular cross-section with equal diameters and disposed one above the other on a common axis; and said feeding chamber defining a cylindrical body for containing a fluid, said cylindrical body defining a wall portion and a fluid delivery measurement indicator on said wall portion, the feeding chamber further comprising a base portion, a lower threaded portion, an externally threaded neck portion defining a mouth, a silicone nipple, and a sealing ring having a body defining an outer wall comprising a plurality of external annular ribs projecting upwardly and said sealing ring further having a hollow center defining a smaller diameter than the outer wall, said body further defining an internally threaded inner wall for mating with said externally threaded neck for closure and securing said silicone nipple to said mouth, said silicone nipple in fluid communication with said feeding chamber; and said lower storage chamber having a body portion with a closed bottom end and an open mouth end defining a cavity therein, said open mouth end comprising a threaded portion, wherein said threaded portion sized and configured to cooperate with said lower threaded portion and attachably receive and support said feeding chamber in an upright position and further configured for holding said sanitary feeding essentials comprising at least one pair of spare nipple and sealing ring assembly therein; and a cap assembly comprising a lower closure cap and at least one attachable cap member defining an upper storage cap, said lower closure cap defining a body having a closed top, an open lower entrance defining a cavity, said closure cap further comprises at least two attachment members;

a first attachment member on an upper portion defining an external annular groove having corresponding structures sized to mate with said storage cap and a second attachment member defining an internally protruding ring member positioned above an edge of said lower entrance for contacting the outer wall of said sealing ring in a friction fit closure method; and said upper storage cap defining a body having a closed top, an open entrance facing downwardly defining a cavity and an internally protruding member defining mating structures to be engageable secured to said lower closure cap and defining a storage compartment therebetween, wherein said storage compartment sized to store at least one spare nipple and a pacifier therein for a later use; and a sleeve made of a suitable and heat resistant material for containing said dual chamber container, said sleeve having a body portion comprising a first cylinder member defining an inner shell with a top end and a bottom end, a second cylinder member defining an outer shell having a top end and a bottom end and said outer shell being larger in diameter than said inner shell defining a gap pocket therebetween, the gap pocket comprises therein a filling mixture of a thick, non-toxic gel and a variety of floatable ornaments, said inner and said outer shells engageably sealed at said top and bottom ends defining an enclosure for securing said filling mixture therein.

2. An improved nursery ensemble of claim 1, wherein said base portion is a closed base.

3. An improved nursery ensemble of claim 1, wherein said lower threaded portion comprises external threads.

4. An improved nursery ensemble of claim 3, wherein said external threads are positioned above the closed base.

5. An improved nursery ensemble of claim 1, wherein said feeding chamber comprising a smaller diameter at said base.

6. An improved nursery ensemble of claim 1, wherein said open mouth end comprising internal threads.

7. An improved nursery ensemble of claim 1, wherein said upper feeding chamber is further a self-supporting container.

8. An improved nursery ensemble of claim 1, wherein said nursery ensemble made of a suitable plastic material being free from bisphenol-a, a harmful compound used in plastic caps and bottles.

9. An improved nursery ensemble of claim 1 wherein said dual chamber container is formed by blow molding.

10. An improved nursery ensemble of claim 1, wherein said sleeve further defining a means for carrying and protecting said container from damage.

11. A nursery ensemble comprising in combination: a dual chamber container defining an upper feeding chamber and a lower storage chamber, said chambers removably engageable having cooperating threaded portions sized to be secured together one above the other and when secured together defining a generally circular cross-section disposed on a common axis; said lower storage chamber comprising a body defining a bottom end and a threaded mouth end defining a cavity therein; and said lower storage chamber dimensioned to support said feeding chamber in an upright position and further sized to receive at least one spare nipple and sealing ring assembly therein; said feeding chamber for containing a liquid, having a fluid measurement indicator on an outer wall portion, said feeding chamber further defining a closed base, a threaded portion above the closed base and an externally threaded neck having a mouth portion defining an opening, a flexible nipple and a sealing ring defining a body having an internally threaded portion on an inner wall mating with said externally threaded neck for closure and securing said flexible nipple to said mouth portion; and a stackable cap assembly defining at least two removably attachable cap members; a lower cap and an upper cap; and said caps defining a generally cylindrical body portion, said upper cap having a closed top portion and a lower entrance facing downwardly defining a cavity therein, said lower cap having a closed top portion and an open lower entrance defining a cavity therein, said upper cap and said lower cap further having a corresponding mating portion sized to be engageable secured together defining a storage compartment therebetween; wherein said upper cap further sized and dimensioned to retain at least one conventional nipple and a pacifier therein, said lower cap further defining an internally protruding ring member and an enclosure that is sized and dimensioned for receiving said flexible nipple and said sealing ring therein; and a protective and entertaining sleeve defining a generally cylindrical shape comprises an elongated body portion sized to completely contain said container therein; said sleeve comprising a tubular inner shell having a top end and a bottom end and a tubular outer shell having a top end and a bottom end, said outer shell being larger in diameter than said inner shell defining a gap pocket therebetween, said gap pocket for containing a filling mixture comprising a pre-measured quantity of a thick gel and floatable ornaments therein, said shells sealed together on an upper portion and a lower portion defining an enclosure for said filling mixture.

12. A nursery ensemble of claim 11, wherein said bottom end is a closed bottom.

13. A nursery ensemble of claim 11, wherein said threaded mouth end comprising internal threads.

14. A nursery ensemble of claim 11, wherein said threaded portion above the closed base comprises external threads.

15. A nursery ensemble of claim 14, wherein said external threads are smaller in diameter than said outer wall portion.

16. A nursery ensemble of claim 11, wherein said tubular shells are made entirely of a transparent silicone material.

17. A nursery ensemble of claim 11, wherein said upper cap and said lower cap secured together in a firm press fit method of closure.

* * * * *